US005616106A

United States Patent [19]

Abelbeck

[11] Patent Number: 5,616,106

[45] Date of Patent: Apr. 1, 1997

[54] EXERCISE DEVICE

[76] Inventor: Kevin Abelbeck, 1220 Venice Blvd. #205, Venice, Calif. 90291

[21] Appl. No.: 530,531

[22] Filed: Sep. 19, 1995

[51] Int. Cl.[6] ..... A63B 21/04; A63B 23/035

[52] U.S. Cl. ..... 482/96; 482/72; 482/126; 482/130; 482/137

[58] Field of Search ..... 482/72, 92–97, 482/129, 130, 137, 142, 126; D21/191, 192, 195

[56] References Cited

U.S. PATENT DOCUMENTS

| | | | |
|---|---|---|---|
| D. 256,822 | 9/1980 | Ozzimo | 482/129 |
| D. 344,112 | 2/1994 | Smith . | |
| D. 356,128 | 4/1993 | Smith . | |
| 4,828,254 | 5/1989 | Maag . | |
| 4,915,378 | 4/1990 | Abrahamian et al. | 482/137 |
| 5,108,095 | 4/1992 | Nichols . | |
| 5,135,216 | 8/1992 | Bingham et al. | 482/130 |
| 5,279,530 | 1/1994 | Hess . | |
| 5,342,269 | 8/1994 | Huang et al. | 482/96 |
| 5,352,171 | 10/1994 | Lin | 482/96 |
| 5,356,358 | 10/1994 | Chen | 482/72 |
| 5,366,432 | 11/1994 | Habing et al. . | |
| 5,423,731 | 6/1995 | Chen | 482/96 |
| 5,478,298 | 12/1995 | Chen | 482/95 |
| 5,507,709 | 4/1996 | Wu | 482/95 |
| 5,507,710 | 4/1996 | Chen | 482/95 |
| 5,520,599 | 5/1996 | Chen | 482/72 |
| 5,527,249 | 6/1996 | Harris | 482/95 |
| 5,533,953 | 7/1996 | Lui et al. | 482/72 |
| 5,547,444 | 8/1996 | Huang | 482/96 |

FOREIGN PATENT DOCUMENTS

| | | | |
|---|---|---|---|
| 2569349 | 2/1986 | France | 482/129 |
| 121354 | 2/1931 | Hungary | 482/142 |
| 496740 | 2/1937 | United Kingdom | 482/130 |

OTHER PUBLICATIONS

HealthRider, ExerHealth Inc., 1276 South 500 West, Salt Lake City, UT, brochure.

Rockit, SoloFlex, Inc., Hawthorn Farm Ind. Park., Hillsboro, OR 97124–6494, brochure.

"An Evaluation and Optimization Model for Exercise Machines which Simulate Stair Stair Climbing", Abelbeck, Kevin G., Infotech, Clouis, CA.

*Primary Examiner*—Richard J. Apley
*Assistant Examiner*—Victor K. Hwang

[57] ABSTRACT

An exercise device is disclosed that properly optimizes body mechanics to create a safe and effective lower body or combination upper body and lower body workout. The invention is comprised of a pad for the user to lay on and a foot plate to press the user's feet against. A lift arm is provided with handles at the user's sides. As the foot plate is pressed away from the body and the lift arm is pulled from the user's sides upward toward the head. A linkage connected to the arm supporting the foot plate and a linkage connected to the lift arm both work to rotate a center frame, which supports the pad thus doing work by vertically displacing the same and therefore the body weight of the user. Additional resistance can be added by an elastic spring which is situated to apply tension to oppose the rotational movement of the center frame relative to the base frame of the invention. Minimal resistance can be applied thereby creating an aerobic activity or increased greatly to provide an anaerobic, muscle building activity, each with minimal stress placed on the lower back of the user.

9 Claims, 3 Drawing Sheets

EXERCISE DEVICE

BACKGROUND OF THE INVENTION

1. Field of the Invention

The invention herein relates to an exercise device and more particularly to an upper and lower body exercise device which can be used as an aerobic training device and also a high resistance muscle building exercise machine.

2. Overview of Prior Art

It is a commonly known that regular exercise is linked to increased health and increased life expectancy. With today's automated lifestyles regular physical exercise is something that most people must consciously add to their daily activities. To make the most productive use of the person's time the design of particular machines are used to facilitate this process in a safer manner. For most people, much of the underlining goal is to reduce body fat. To do this the greatest amount of work must be accomplished by the exercising person. This will invariably utilize the larger muscle groups in the body, which include the legs. An optimal design will include the ability to exercise both aerobically at a low intensity for a long period of time and anaerobically at a high intensity for a shorter period of time and the device should be fun to use. If the person does not enjoy using the machine, it will inevitably end up in the garage.

Several factors predispose such a product to success or failure. One such desirable trait is the ability to be made lightweight and inexpensive enough for the home market. Habling et al. in U.S. Pat. No. 5,366,432 disclosed a leg press machine in which the larger muscles of the legs and hips are utilized but the relative size and expense of such a device limits its use predominantly to a gym. In addition there is no means of working any upper body exercises on this design.

Hess in U.S. Pat. No. 5,279,530 discloses a home unit that works the leg muscles of the user. The problems include the resistance means, which is limited to an elastic cord that is not easily adjustable. In addition, the pedals are on linear tracks and therefore their movement lacks a realistic representation of natural body movement. It has been determined by a biomechanical model by Abelbeck in "*An Evaluation and Optimization Model for Exercise Machines which Simulate Stair Climbing*" that a gentle arc is preferred in simulating the most natural movement of the extension of the hip and knee. Also, the "fun" aspect has been totally removed from this device. One of the important features of an enjoyable physical activity of this sort is stimulation of the senses and particularly the Vestibular Apparatus in the inner ear. This pleasurable feeling which accompanies swinging or rocking in a rocking chair takes place from two aspects, linear acceleration associated with starting and stopping as well as rotational acceleration that accompanies a change in direction. In many designs, including the Hess patent, the head is stationary and therefore totally void of such stimulation.

Start and stop movement as well as minimal rotational acceleration is provided in the disclosure of Nichols in U.S. Pat. No. 5,108,095. The bulky size and associated expense minimize the effectiveness of such products in the home marketplace. In addition to the lack of upper body training, the minimum resistance provided is the user's body weight plus the weight of the machine. This would greatly limit the usefulness of an aerobic activity to only those in top physical condition. Therefore, the minimal angular acceleration felt by the user due to the use of a four bar linkage in which the upper body does not rotate with respect to the world is of little consequence since few people would be physically capable of a prolonged use of the machine anyway.

Designing a machine to conform to the body is paramount in importance in the world of exercise equipment. Variations from natural movements not only make the device less than effective, but injuries can occur from degeneration of connective tissue from repeated movements that are atypical to the body. The variation in resistance to the muscles as it applies to the muscles capability to perform work is addressed by Maag in U.S. Pat. No. 4,828,254. The resistance to the muscles of the legs is increased by mechanical means in accordance with the increased capacity of the body as the legs approach full extension relative to a flexed position. Here, as with the Nichols patent, lesser resistance to accommodate prolonged, repetitive movement is not practical for the majority of the users. Also, the physical size and the use of weights to make it effective limit this device to an anaerobic activity in a gym.

The ROCKIT produced by SOLOFLEX is designed to be used as an aerobic training device, but failed to account for biomechanical strength potentials in lifting the body on a simple linkage as shown in the literature. With the pivot point behind and below the body the resistance moment arm decreases as the platform pivots back. This is just the opposite of the strength potential of the body. The application of the spring resistance helps to overcome this but varies in contribution with the level of spring resistance. Additionally the lack of upper body conditioning makes this a less than adequate device.

The HEALTH RIDER offers some of the advantages as stated as desirable, as are illustrated by Smith in U.S. Pat. Des. Nos. 344,112 and 356,127. The benefits include the vestibular stimulation as making it fun to use, but it falls short in functionality due to unnatural movement and excessive strain on the lower back during the movement. This can be seen in the literature which illustrates that the handle for the arm movement is pulled in toward the midsection of the body at the end of the movement. Without any trunk support, this creates a disproportionately high stress on the lower back muscles and associated structures as compared to other major muscles such as the legs. This not only greatly limits the functionality of the device but predisposes the user to degenerative overuse of an already common problem area in the general public, low back pain from overuse. Thus for some persons who are physically able to use this device, they shouldn't. Their health risk is greater than their potential health benefit.

SUMMARY OF THE INVENTION

The object of the disclosed invention is to provide a means of safely and enjoyably exercising the lower body alone or lower body in conjunction with specific upper body muscles. The larger muscles are worked with a capability of working in a long duration, low intensity method or for short duration, high intensity training. The resistance is comprised of a portion of the user's body weight which is supplemented by a spring or elastic tension means. The path of motion of the feet with respect to the supported trunk has been biomechanically determined to be optimal in terms of the balance of muscle potential and resistance applied to those muscles.

The upper body portion of the ergometer is comprised of an exercise arm which moves with the user and is tied into the linkage that is actuated by the leg movement. The path of motion of the handle stresses the muscles of the arms and shoulders without placing excessive stress to the lower back of the user.

The resulting rocking motion of the body while the invention is in use provides gentle stimulation of the vestibular apparatus in the inner ear thus making it enjoyable to use. As with any exercise device, especially one that can be used as an aerobic exerciser, due to use for a prolonged period of time, it must create some pleasurable feeling from performing the activity or it will not be used. The usefulness of any exercise device is nonexistent if it is not used.

DETAILED DESCRIPTION OF THE PREFERRED EMBODIMENT

Figure 1:
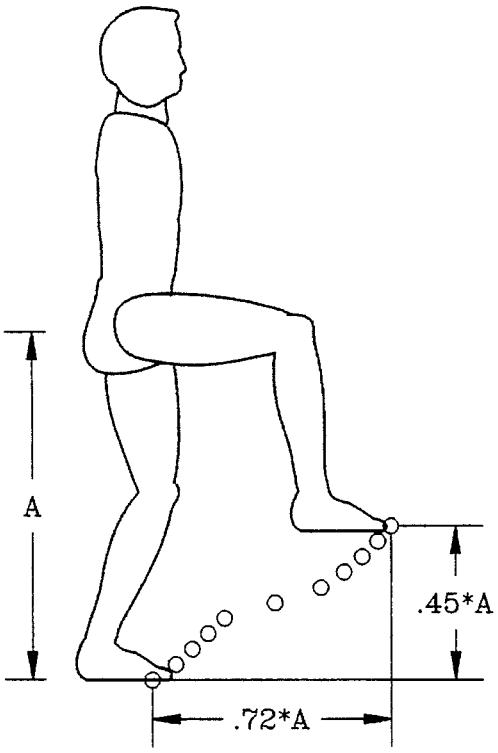
FIG. 1 is a schematic view of the model of the optimal foot path of travel as referenced and used by the disclosed invention as produced in accordance with the preferred embodiment.

Referring to the drawings, a reference figure that illustrates the mathematically derived optimal foot path of travel for the device constructed in accordance with the present invention is shown in FIG. 1. The importance in utilizing an optimal foot path of travel is vital in such a device. By changing the relative positions and joint angles of the body, the major muscle movers' relative contributions are altered. By balancing the strength potentials of the specific muscles to the load incurred by manipulating the moment of load applied, through joint position to the line of force application in addition to the varied potential of the individual joint angle, a harmony of load verses potential can be achieved. When this happens, the body moves in a pattern that is comfortable and in terms of exercise, and the likelihood of overuse injuries due to unfamiliar loading and wearing of connective tissue and structures are theoretically reduced. In addition, in terms of functionality the individual can do more work for a longer period of time because no one muscle group will fatigue before the rest, thus the "weak link" has been eliminated. This optimization model is illustrated for the lower body in a pushing or stepping motion as indicated by the circles, is utilized in the disclosed invention.

Figure 2:
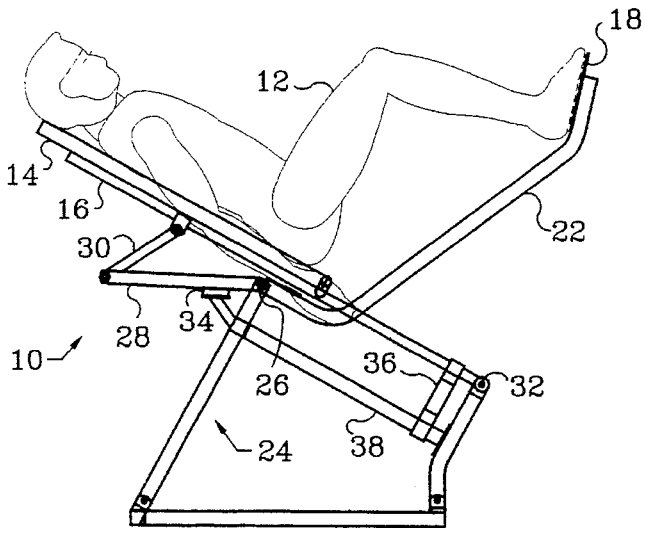
FIG. 2 is a side view of an exercise machine for exercising the lower body shown at the starting position, the device produced in accordance with the preferred embodiment of the present invention.

In FIG. 2 a side view of the lower body version 10 of the invention is shown. The user 12 lies on his back on a pad 14 which enables the user's back to be supported during the movement. The pad 14 is fastened to a center frame 16 and the user places his feet against the foot plate 18 and grasps a pair of frame handles 20 located at his sides. The foot plate 18 is connected to a pivot arm 22 which is pivotally connected to the frame 24 at a second base pivot 26. A link arm 28 rotates with the pivot arm 22 to move the push bar 30 which is pivotally connected to the center frame 16. This movement causes the center frame 16 to rotate about a first base pivot 32, and move upward with respect to the base 24. The user's body weight is displaced vertically approximately half of the distance of a traditional squat, thus providing a movement in which the back is supported and a less than real world resistance is applied. This is important for individuals that would have difficulty performing the movement without assistance. A stopper 34 sets the resting position of the device to allow the person to safely enter and exit the invention.

In order that a variety of physical capabilities and training criteria can be accommodated by the device, a tension spring 36 is shown positioned between the center frame 16 and an inclined frame member 38 of the base 24. The tension spring 36 is preferably made of some durable and elastic material such as rubber neoprene or polyurethane and is assembled onto the members as described. As the center frame 16 rotates it is displaced away from the inclined frame member 38 thereby applying additional load to the movement of the pivot arm 22 and ultimately the user. The tension produced and the work done by the user can be altered by sliding the spring 36 further away from the first pivot 32. The further away from the pivot 32, the greater the displacement of the center frame 16 from the base frame 38. Thus, according to Hook's Law for a spring (the tension is proportional to the displacement beyond resting length) the tension increases as the spring 36 is moved away from the pivot 32. This increase is compounded by the increase in the moment caused by the perpendicular distance from the line of action of the spring 36 to the pivot 32. The invention can provide a great variety in resistance by moving the spring which supplies a supplemental load to the exerciser 12. This enables both a high intensity anaerobic muscle building workout as well as a long duration, low intensity aerobic workout with only a simple adjustment of the spring 36. With or without the use of the spring 36 the device is fully functional because of the amount of work done by moving the body 12 and the design of the linkage provides an increase in load at the end of the movement as compared to the beginning of the movement, thereby more closely simulating their body's strength potential.

Figure 3:
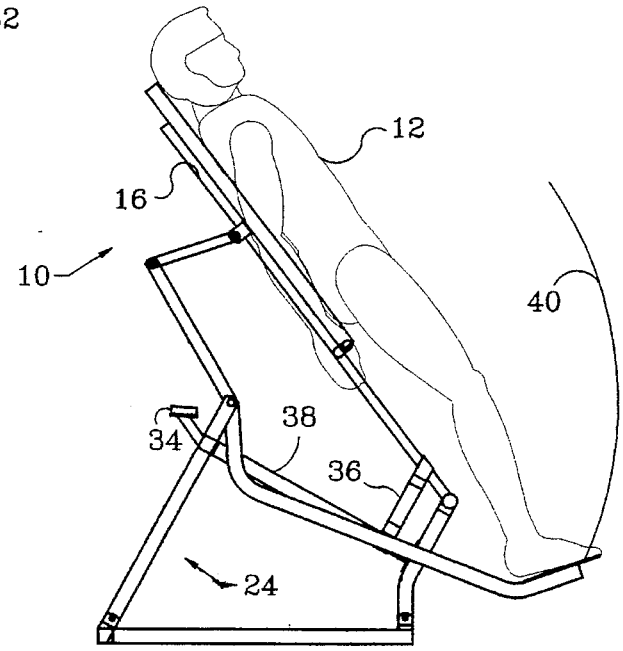
FIG. 3 is a side view of an exercise machine for exercising the lower body shown at the final or extended position, the device produced in accordance with the preferred embodiment of the present invention.

With reference now to FIG. 3, the displacement of the center frame 16 and the inclined frame member 38 is illustrated here in the final position of the invention. The displacement of the spring 36 is easily seen to change in relation to the relative positions on the frame members 16 and 38. The path of motion of the foot 40 is shown here relative to the frame 24. Since the body 12 is rotating as well, a simulation of the optimal path shown in FIG. 1 is made by producing a simple are 40 in addition to minimizing the space floor necessary to use the machine 10. The anterior rocking motion provided to the user is a pleasurable feeling due to the stimulation of the vestibular apparatus in the inner ear. This is important because it adds enjoyment to the use of the device, therefore increasing the potential repeated use of the invention. Any exercise device is only useful if it is used.

Figure 4:
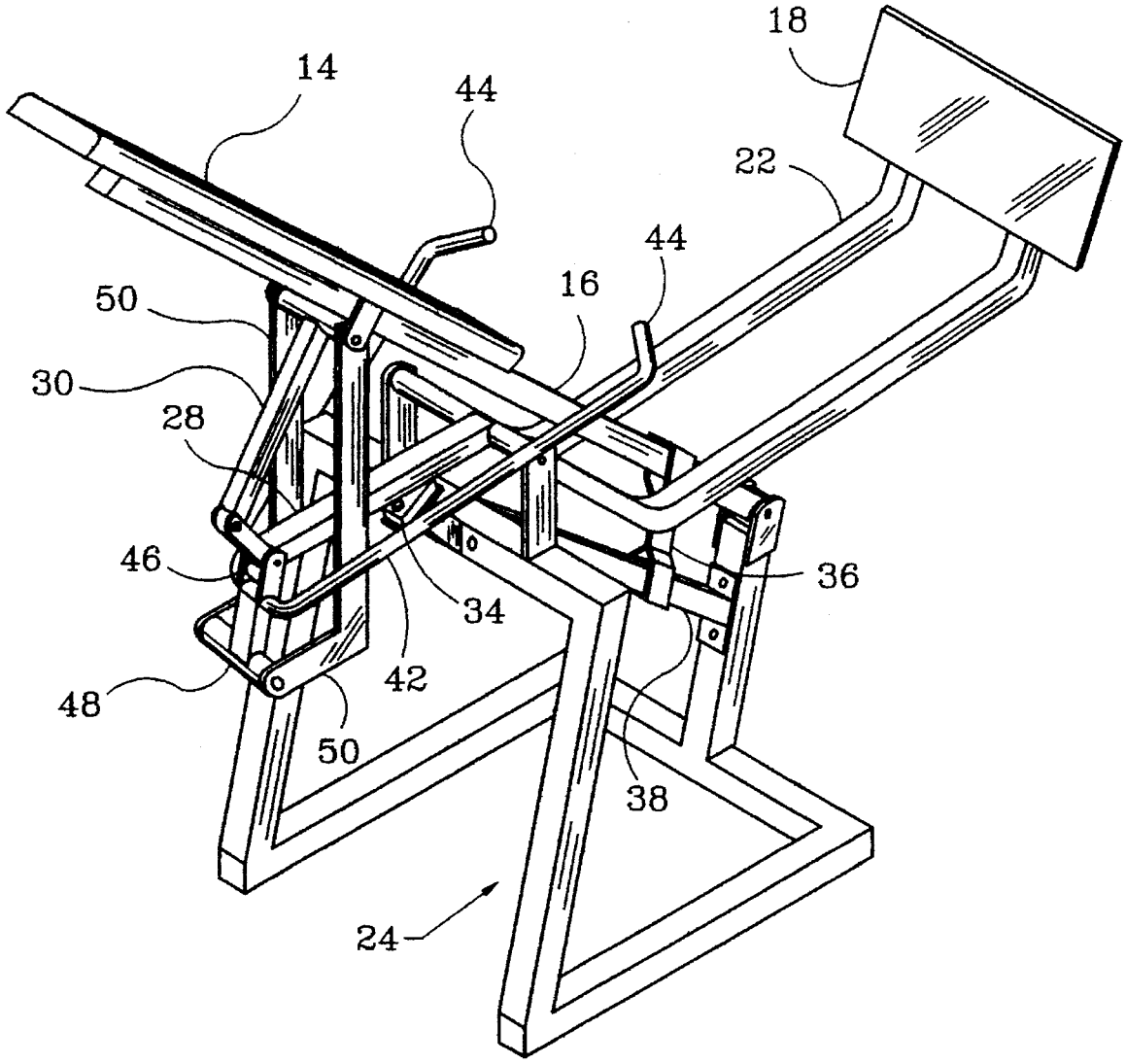
FIG. 4 is a side rear isometric view of an exercise machine for exercising both the upper and lower body, showing the linkage system of a device as produced in accordance with the preferred embodiment of the present invention.

The invention can also be utilized as an upper body exerciser and a lower body exerciser as shown in FIG. 4. Here the components that train the lower body, including the foot plate 18, pivot arm 22, center frame 16, link ann 28, push bar 30, spring 36 and pad 14 are all used as described in FIGS. 2 and 3. The addition of a lift arm 42 in which right and left ann handles 44 are provided to the user to grasp with his hands, enables the muscles of the arms, shoulders and trapezius muscle to also be exercised. The lift arm 42 rotates with respect to the frame 24 at an arm pivot 46 in the link arm 28. To cause the arm 42 to actuate with the action of the pivot arm 22, a second arm pivot 48 is provided. This second pivot 48 is pivotally connected to the center frame 16 by a pair of push links 50, thus necessitating movement of the arm 42 as the machine actuates.

Figure 5:
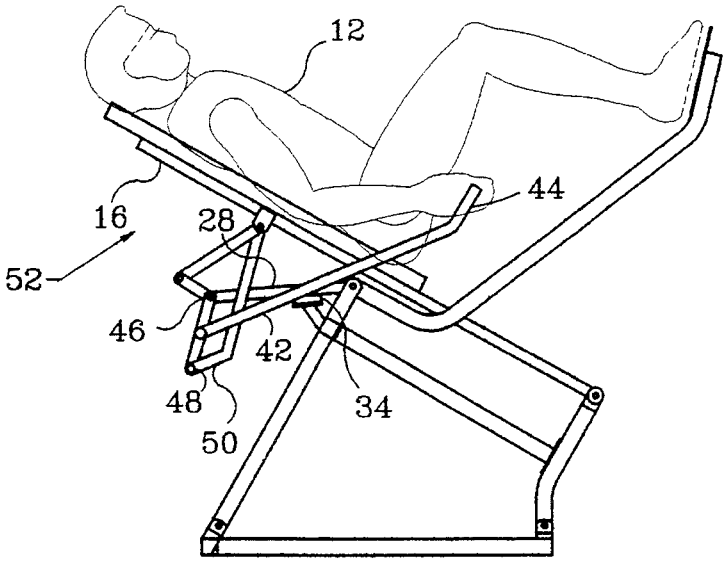
FIG. 5 is a side view of an exercise machine utilizing both the upper body and the lower body of the user, shown at the starting position, the device produced in accordance with the preferred embodiment of the present invention.

The actuation of the whole body exerciser 52 is shown in its starting position in FIG. 5. In this, the lift arm 42 is shown to provide arm handles 44 to the user 12. The arm pivot 46 is shown in its pivotal connection to the link arm 28, while providing a second arm pivot 48 to connect the arm 42 to the center frame 16 by the push links 50. The link arm 28 rests on the stopper 34 in this position similar to the lower body version depicted in FIGS. 2 and 3.

Figure 6:
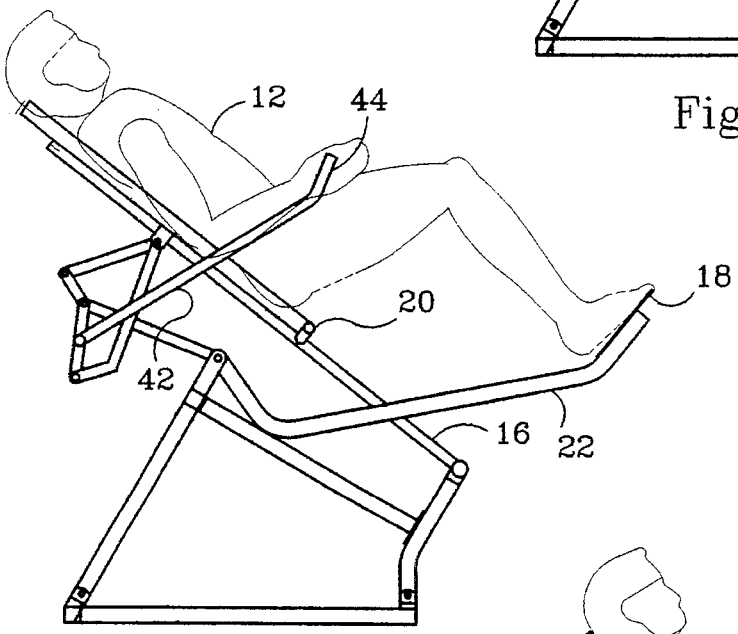
FIG. 6 is a side view of an exercise machine utilizing both the upper body and the lower body of the user, shown at the mid range position, the device produced in accordance with the preferred embodiment of the present invention.

The mid range position of the invention as shown in FIG. 5 is shown here in FIG. 6. Here it is seen as the pivot arm 22 is rotated down, not only does the center frame 16 rotate up, but the lift arm 42 also rotates up. By grasping the arm handles 44 and pulling up in an upright rowing motion, the movement of the machine is facilitated against the resistance of the body weight of the user 12 and/or a resistance spring. The spring is not shown here to illustrate the functionality of the invention without the spring as well as with it. The precise geometrical positions and lengths of the links and pivots make for a smooth and flowing motion of the arm handles 44 and foot plate 18 each through a path of travel that is familiar to the user and without placing excessive stress on sensitive areas such as the lower back of the user 12. If only the lower body is desired to be exercised, the frame handles 20 can be provided thereby allowing the user to ignore the moving arm handles 44.

Figure 7:
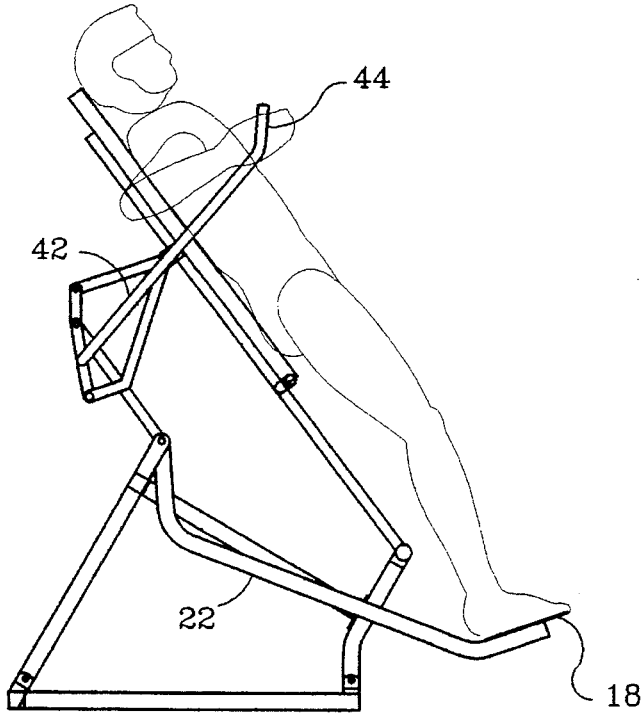
FIG. 7 is a side view of an exercise machine utilizing both the upper body and the lower body of the user, shown at the ending position, the device produced in accordance with the preferred embodiment of the present invention.

The final position of the invention is shown in FIG. 7. Here the lift arm 42 and arm handles 44 are in their upper most position as the foot plate 18 and pivot arm 22 are in their bottom most positions. The associated linkages providing that movement, function consistent with that earlier described resulting in maximal work done by utilizing large muscles in a safe and supported manner while rotating the body to create a desired pleasurable stimulus during the exercise.

What is claimed is:

1. An exercise device comprising:

A. a base frame supporting a first pivot and a second pivot;

B. a longitudinal center frame with one end pivotally mounted to said first pivot and a pad secured to a portion of an upper side of the center frame adapted to support the back of a user;

C. a longitudinal pivot ann with the distal end positioned on one side of said second pivot of said base frame and the other end pivotally mounted to said second pivot of said base frame;

D. at least one link arm continuous with said pivot arm and supporting a third pivot on the distal end of the at least one link arm, the third pivot positioned away from said distal end of said pivot arm; and E. at least one push bar with a first end and a second end, the first end pivotally mounted to said third pivot and the second end pivotally mounted to said center frame, whereby when the user lies with his/her back against said pad with his/her knees and hips in a flexed position and his/her feet positioned against said distal end of said pivot arm, the user can fully extend his/her legs, thereby rotating said pivot arm and said link arm to move the at least one, push bar, moving said center frame upwardly, raising the body of the user, thus doing work and exercising the muscles of the user while maintaining contact between the user's back and the pad, thereby supporting the user's back.

2. The exercise device as described in claim 1, further comprising an elastic tension means, slidably mounted to said center frame and said base frame, a distance from said first pivot, whereby as the center frame is rotated, the center frame and the base frame are displaced one from another, the elastic tensioning means is then elongated in a relation to the distance the tension means is located away from said first pivot, thus providing a variable increase in resistance to the user.

3. The exercise device as described in claim 2, wherein said elastic tensioning means is constructed of a material selected from the group consisting of rubber, neoprene and polyurethane.

4. An exercise device comprising:

A. a base frame supporting a first pivot and a second pivot;

B. a longitudinal center frame with one end pivotally mounted to said first pivot and a pad secured to a portion of the upper side of the center frame;

C. a longitudinal pivot arm with the distal end positioned on one side of said second pivot of said base frame and the other end pivotally mounted to said second pivot of said base frame;

D. at least one link arm continuous with said pivot arm and supporting a third pivot and a fourth pivot located thereon, the third pivot and the fourth pivot positioned away from said distal end of said pivot arm;

E. at least one push bar with a first end and a second end, the first end pivotally mounted to said third pivot of said at least one link arm and the second end pivotally mounted to said center frame;

F. at least one side arm providing at least one handle at the right and left sides of a user positioned in the device, the at least one side arm also including a first arm pivot and a second arm pivot, the first arm pivot being pivotally mounted to said fourth pivot of said at least one link arm; and G. at least one push link with a first end and a second end, the first end pivotally mounted to said second ann pivot of said at least one side arm and the second end pivotally mounted to said center frame, whereby when a user lies with his/her back against said pad with his/her knees and hips in a flexed position, his/her feet positioned against said distal end of said pivot arm and his/her hands grasping said at least one handle, the user extends his/her legs and moves his/her arms, thereby rotating said pivot arm and said at least one link arm to move said at least one push bar while also moving said at least one handle, thus displacing said at least one push link, both the movements of said at least one push link and said at least one push bar moving said center frame upwardly, raising the body of the user, thus doing work and exercising the muscles of the user.

5. The exercise device as described in claim 4, further comprising an elastic tension means, slidably mourned to said center frame and said base frame, a distance from said first pivot, whereby as the center frame is rotated the center frame and the base frame are displaced one from another, the elastic tensioning means is then elongated in a relation to the distance the tension means is located away from said first pivot, thus providing a variable increase in resistance to the user.

6. The exercise device as described in claim 5, wherein said elastic tensioning means is constructed of a material selected from the group consisting of rubber, neoprene and polyurethane.

7. An exercise device comprising:

A. a base frame supporting a first pivot and a second pivot;

B. a longitudinal center frame with one end pivotally mounted to said first pivot and a pad secured to a portion of the upper side of the center frame;

C. a longitudinal pivot arm with the distal end positioned on one side of said second pivot of said base frame and the other end pivotally mounted to said second pivot of said base frame;

D. at least one link arm continuous with said pivot arm and supporting at least one pivot;

E. at least one first linkage means, pivotally connecting said at least one link arm to said center frame, each connection being non-colinear with said first and said second pivots;

F. at least one side arm providing at least one handle at the right and left sides of a user positioned in the device, the at least one side arm also including a first arm pivot and a second arm pivot, the first arm pivot being pivotally mounted to said at least one pivot of said at least one link arm; and G. at least one second linkage means, pivotally connecting said at least one side arm at said second arm pivot to said center frame, being non-colinear with said first pivot, whereby when a user lies with his/her back against said pad with his/her knees and hips in a flexed position, his/her feet positioned against said distal end of said pivot arm and his/her hands grasping said at least one handle, the user extends his/her legs and moves his/her arms, thereby rotating said pivot arm to move said at least one link arm and said first linkage means while also moving said at least one handle, thus displacing said second linkage means, both the movements of said first and said second linkage means moving said center frame upwardly, raising the body of the user, thus doing work and exercising the muscles of the user.

8. The exercise device as described in claim 7, further comprising an elastic tension means, slidably mounted to said base frame, a distance from said first pivot, whereby as the center frame is rotated, the center frame and the base frame are displaced one from another, the elastic tensioning means is then elongated in a relation to the distance the tension means is located away from said first pivot, thus providing a variable increase in resistance to the user.

9. The exercise device as described in claim 8, wherein said elastic tensioning means is constructed of a material selected from the group consisting of rubber, neoprene and polyurethane.

* * * * *